US010964265B2

(12) United States Patent
Xu

(10) Patent No.: US 10,964,265 B2
(45) Date of Patent: Mar. 30, 2021

(54) PIXEL CIRCUIT, PIXEL ARRAY, DISPLAY DEVICE, AND DRIVING METHOD FOR IMPROVING DISPLAY UNIFORMITY

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Yingsong Xu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/520,609

(22) Filed: Jul. 24, 2019

(65) Prior Publication Data

US 2020/0152118 A1 May 14, 2020

(30) Foreign Application Priority Data

Nov. 13, 2018 (CN) ..... 201811343986.7

(51) Int. Cl.
*G09G 3/325* (2016.01)
*G09G 3/3258* (2016.01)

(52) U.S. Cl.
CPC ..... *G09G 3/325* (2013.01); *G09G 3/3258* (2013.01); *G09G 2310/0264* (2013.01)

(58) Field of Classification Search
CPC ..... G09G 3/325; G09G 3/3258; G09G 2310/0264; G09G 3/3233;
(Continued)

(56) References Cited

U.S. PATENT DOCUMENTS

2016/0343305 A1* 11/2016 Kamiyamaguchi .. G09G 3/3241
2016/0358531 A1* 12/2016 Nakakita ..... G09G 3/3266

FOREIGN PATENT DOCUMENTS

CN 102290027 A 12/2011
CN 104134680 A 11/2014
CN 107909966 A 4/2018

OTHER PUBLICATIONS

First Office Action for CN Appl. No. 201811343986.7, dated Jan. 3, 2020.

* cited by examiner

*Primary Examiner* — Temesghen Ghebretinsae
*Assistant Examiner* — Ivelisse Martinez Quiles
(74) *Attorney, Agent, or Firm* — The Webb Law Firm

(57) ABSTRACT

The present disclosure provides a pixel circuit, a pixel array, a display device, and a driving method. The pixel circuit includes a pre-storage sub-circuit, a driving sub-circuit, a first reset sub-circuit, and a light emitting control sub-circuit. The pre-storage sub-circuit is used to maintain and provide a data voltage of a current frame image, and pre-store a data voltage of a next frame image. The driving sub-circuit is used to drive a light emitting device to emit light. The first reset sub-circuit is used to be turned on during the reset phase to transmit the reference voltage to the driving sub-circuit and turned off during a time period other than the reset phase. The light emitting control sub-circuit is used to control that the driving sub-circuit is coupled to or decoupled from the light emitting device.

13 Claims, 7 Drawing Sheets

(58) Field of Classification Search
CPC ..... G09G 3/30–3258; G09G 2310/061; G09G 2300/0852; G09G 2300/0861; G09G 2300/0819
See application file for complete search history.

PIXEL CIRCUIT, PIXEL ARRAY, DISPLAY DEVICE, AND DRIVING METHOD FOR IMPROVING DISPLAY UNIFORMITY

CROSS-REFERENCE TO RELATED APPLICATIONS

The present application claims priority to Chinese Patent Application No. 201811343986.7, filed on Nov. 13, 2018, the disclosure of which is incorporated by reference herein in its entirety.

TECHNICAL FIELD

The present disclosure relates to a pixel circuit, a pixel array, a display device, and a driving method.

BACKGROUND

In recent years, since the AMOLED (Active Matrix Organic Light Emitting Diode) display presents an excellent display effect, the AMOLED industry at home and abroad has developed rapidly so that various pixel circuits have been developed successively. At present, in actual production, a TFT (Thin Film Transistor) of a display may be manufactured by processes such as ELA (Excimer Laser Annealing) and Doping.

SUMMARY

According to one aspect of embodiments of the present disclosure, a pixel circuit is provided. The pixel circuit comprises: a pre-storage sub-circuit configured to maintain a data voltage of a current frame image to be displayed during a reset phase, provide the data voltage of the current frame image during a data providing phase, and pre-store a data voltage of a next frame image during a light emitting phase; a driving sub-circuit configured to drive a light emitting device to emit light according to the data voltage of the current frame image and a reference voltage from a reference voltage terminal; a first reset sub-circuit electrically connected between the driving sub-circuit and the reference voltage terminal, and configured to be turned on during the reset phase to transmit the reference voltage to the driving sub-circuit and turned off during a time period other than the reset phase; and a light emitting control sub-circuit configured to control the driving sub-circuit to couple to or decouple from the light emitting device, wherein both the data providing phase and the reset phase are within a period during which the driving sub-circuit is decoupled from the light emitting device.

In some embodiments, the pre-storage sub-circuit comprises: a first switching transistor, of which a first electrode is configured to receive the data voltage of the current frame image or the data voltage of the next frame image from a data line, a second electrode is electrically connected to a first node, and a control terminal is configured to receive a strobe signal, wherein the first switching transistor is configured to be turned on in response to the strobe signal during the light emitting phase; a second switching transistor, of which a first electrode is electrically connected to the first node, a second electrode is electrically connected to a second node, and a control terminal is configured to receive a switching signal, wherein the second switching transistor is configured to be turned on in response to the switching signal during the data providing phase; and a first capacitor, of which an end is electrically connected to the reference voltage terminal and another end is electrically connected to the first node.

In some embodiments, the driving sub-circuit comprises: a driving transistor, of which a first electrode is electrically connected to a power supply voltage terminal, a second electrode is electrically connected to a third node, and a control terminal is electrically connected to the second node; and a second capacitor, of which an end is electrically connected to the second node and another end is electrically connected to the third node.

In some embodiments, the first reset sub-circuit comprises: a third switching transistor, of which a first electrode is electrically connected to the reference voltage terminal, a second electrode is electrically connected to the second node, and a control terminal is configured to receive a first reset signal, wherein the third switching transistor is configured to be turned on in response to the first reset signal during the reset phase.

In some embodiments, the light emitting control sub-circuit comprises: a fourth switching transistor, of which a first electrode is electrically connected to the third node, a second electrode is electrically connected to an anode terminal of the light emitting device, and a control terminal is configured to receive a control signal, wherein the fourth switching transistor is configured to be turned on or off in response to the control signal.

In some embodiments, the pixel circuit further comprises: a second reset sub-circuit configured to reset a potential of the third node in response to a second reset signal during the reset phase.

In some embodiments, the second reset sub-circuit comprises: a fifth switching transistor, of which a first electrode is electrically connected to the third node, a second electrode is electrically connected to a first voltage terminal, and a control terminal is configured to receive the second reset signal, wherein the fifth switching transistor is configured to be turned on in response to the second reset signal during the reset phase.

In some embodiments, the pixel circuit further comprises: a third reset sub-circuit configured to reset a potential of the first node before the data voltage of the next frame image is stored at the first node.

In some embodiments, the third reset sub-circuit comprises: a sixth switching transistor, of which a first electrode is electrically connected to the first node, a second electrode is electrically connected to a second voltage terminal, and a control terminal is configured to receive a third reset signal, wherein the sixth switching transistor is configured to be turned on in response to the third reset signal.

In some embodiments, in a case where the strobe signal received by the first switching transistor is an nth strobe signal, the third reset signal is an (n−1)th strobe signal, wherein n is a positive integer no less than 2.

In some embodiments, the pixel circuit further comprises: the light emitting device, electrically connected to the light emitting control sub-circuit.

According to another aspect of embodiments of the present disclosure, a pixel array is provided. The pixel array comprises a plurality of pixel circuits as described previously.

According to another aspect of embodiments of the present disclosure, a display device is provided. The display device comprises the pixel array as described previously.

According to another aspect of embodiments of the present disclosure, a driving method for a pixel circuit is provided. The driving method for a pixel circuit comprises:

decoupling a driving sub-circuit from a light emitting device by a light emitting control sub-circuit; transmitting a reference voltage to the driving sub-circuit by a first reset sub-circuit and maintaining a data voltage of a current frame image to be displayed by a pre-storage sub-circuit during a reset phase, wherein the reset phase is within a period during which the driving sub-circuit is decoupled from the light emitting device; providing the data voltage of the current frame image to the driving sub-circuit by the pre-storage sub-circuit during a data providing phase after the reset phase, wherein the data providing phase is within the period during which the driving sub-circuit is decoupled from the light emitting device; coupling the driving sub-circuit to the light emitting device by the light emitting control sub-circuit, and driving the light emitting device to emit light by the driving sub-circuit according to the data voltage of the current frame image and the reference voltage; and pre-storing a data voltage of a next frame image by the pre-storage sub-circuit during a light emitting phase.

In some embodiments, the pre-storage sub-circuit comprises a first switching transistor, a second switching transistor and a first capacitor, a first electrode of the first switching transistor configured to receive the data voltage of the current frame image or the data voltage of the next frame image from a data line, a second electrode of the first switching transistor electrically connected to a first node, a control terminal of the first switching transistor configured to receive a strobe signal, a first electrode of the second switching transistor electrically connected to the first node, a second electrode of the second switching transistor electrically connected to a second node, and a control terminal of the second switching transistor configured to receive a switching signal, an end of the first capacitor electrically connected to a reference voltage terminal, and another end of the first capacitor electrically connected to the first node; the step of providing the data voltage of the current frame image by the pre-storage sub-circuit comprises: applying the switching signal to the second switching transistor such that the second switching transistor is turned on to transmit the data voltage of the current frame image to the second node; the step of pre-storing the data voltage of the next frame image by the pre-storage sub-circuit comprises: applying the strobe signal to the first switching transistor during the light emitting phase such that the first switching transistor is turned on to write the data voltage of the next frame image into the first node.

In some embodiments, the driving sub-circuit comprises a driving transistor and a second capacitor, a first electrode of the driving transistor electrically connected to a power supply voltage terminal, a second electrode of the driving transistor electrically connected to a third node, a control terminal of the driving transistor electrically connected to the second node, an end of the second capacitor electrically connected to the second node, and another end of the second capacitor electrically connected to the third node; the driving method further comprises: resetting a potential of the third node by a second reset sub-circuit during the reset phase.

In some embodiments, the driving method further comprises: resetting a potential of the first node by a third reset sub-circuit before the data voltage of the next frame image is stored at the first node.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure may be more clearly understood from the following detailed description with reference to the accompanying drawings, in which.

Figure 1:
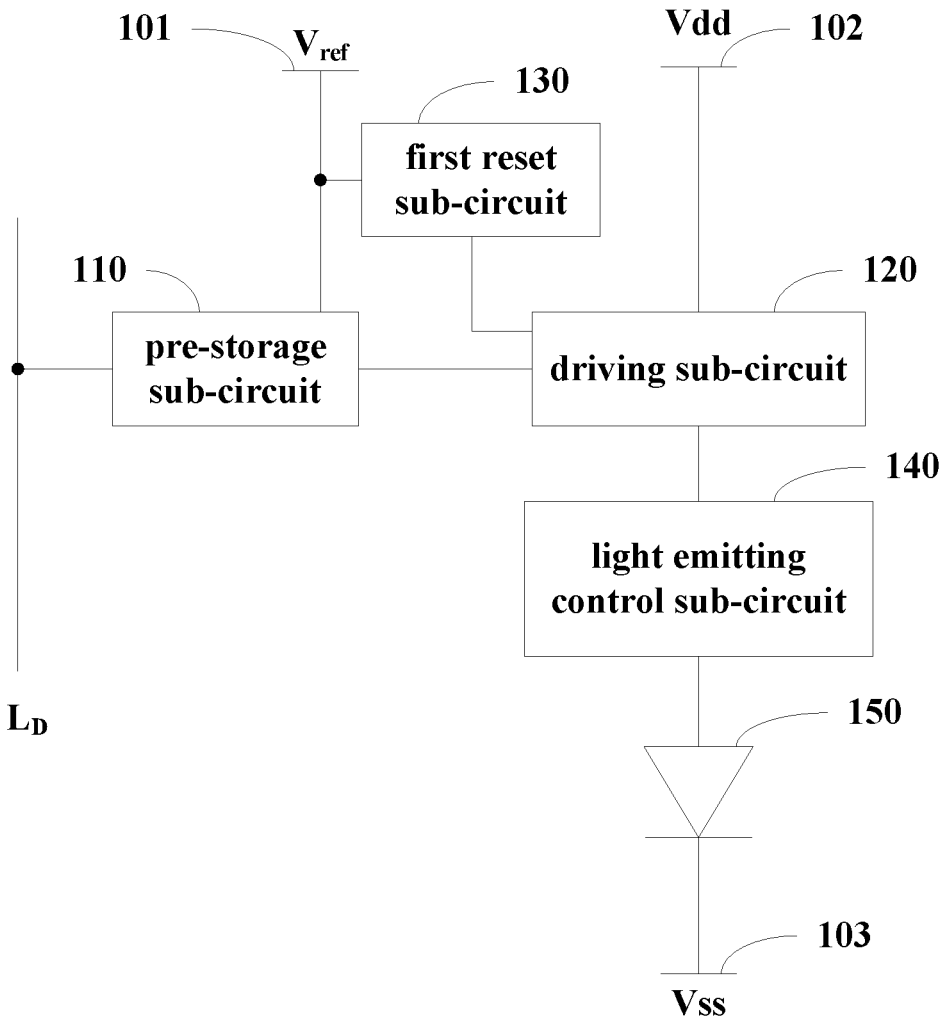
FIG. 1 is a structure diagram showing a pixel circuit according to an embodiment of the present disclosure.

It should be understood that the dimensions of the various parts shown in the accompanying drawings are not drawn according to the actual scale. In addition, the same or similar reference signs are used to denote the same or similar components.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "include" or variants thereof means that the element before the word covers the element(s) listed after the word without excluding the possibility of also covering other elements. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is electrically connected to other devices, the particular device may be directly electrically connected to said other devices without an intermediate device, and alternatively, may not be directly electrically connected to said other devices but with an intermediate device.

Unless otherwise defined, all terms (including technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

The inventors of the present disclosure have found that the processes of ELA and doping applied in actual production cannot ensure that the TFT presents a favorable uniformity, so that there is a phenomenon of a threshold voltage ($V_{th}$) deviation in the TFT, which results in a comparatively poor display uniformity of the display. Taking the most basic 2T1C pixel circuit (the circuit comprises two transistors and one capacitor) as an example, when the same data signal is written into the pixel circuit, it is possible to result in non-uniform brightness of various pixels due to the different $V_{th}$ in the driving current formula of different pixel circuits.

In view of this, embodiments of the present disclosure provide a pixel circuit to reduce the influence of a threshold voltage on display uniformity and improve the display uniformity.

FIG. 1 is a structure diagram showing a pixel circuit according to an embodiment of the present disclosure. As shown in FIG. 1, the pixel circuit may comprise a pre-storage sub-circuit 110, a driving sub-circuit 120, a first reset sub-circuit 130, and a light emitting control sub-circuit 140. In addition, FIG. 1 also show a data line $L_D$ providing a data voltage, a reference voltage terminal 101 providing a reference voltage $V_{ref}$, a power supply voltage terminal 102 providing a power supply voltage $V_{dd}$, and a common ground terminal 103 providing a common ground terminal voltage $V_{ss}$.

The pre-storage sub-circuit 110 is configured to maintain a data voltage of a current frame image to be displayed during a reset phase, provide the data voltage of the current frame image during a data providing phase, and pre-store a data voltage of a next frame image during a light emitting phase. For example, the pre-storage sub-circuit 110 may provide a pre-stored data voltage of the current frame image to be displayed to the driving sub-circuit 120 during the data providing phase, and receive and pre-store the data voltage of the next frame image from the data line $L_D$ during the light emitting phase.

The driving sub-circuit 120 is electrically connected to the reference voltage terminal 101. The driving sub-circuit 120 is configured to drive a light emitting device 150 to emit light according to the data voltage of the current frame image and the reference voltage $V_{ref}$ from the reference voltage terminal 101. The driving sub-circuit 120 is also electrically connected to the power supply voltage terminal 102.

It should be noted that, when it is described that a particular device is electrically connected to other devices, the particular device may be directly electrically connected to said other devices without an intermediate device, and alternatively, may not be directly electrically connected to said other devices but with an intermediate device.

The first reset sub-circuit 130 is electrically connected between the driving sub-circuit 120 and the reference voltage terminal 101. The first reset sub-circuit 130 is configured to be turned on during the reset phase to transmit the reference voltage to the driving sub-circuit 120, and turned off during a time period other than the reset phase.

The light emitting control sub-circuit 140 is configured to control the driving sub-circuit 120 to couple to or decouple from the light emitting device 150. Both the data providing phase and the reset phase are within a period during which the driving sub-circuit is decoupled from the light emitting device (i.e., a non-light-emitting phase).

In the above-described embodiments, a pixel circuit according to some embodiments of the present disclosure is provided. In the pixel circuit, a light emitting control sub-circuit is used to control a driving sub-circuit to decouple from a light emitting device. A first reset sub-circuit is used to transmit a reference voltage to the driving sub-circuit during a reset phase. A pre-storage sub-circuit is used to provide a data voltage of a current frame image to be displayed to the driving sub-circuit during a data providing phase. The data providing phase and the reset phase are within a period during which the driving sub-circuit is decoupled from the light emitting device. The light emitting control sub-circuit is also used to control the driving sub-circuit to couple to the light emitting device. The driving sub-circuit is used to drive the light emitting device to emit light according to the data voltage of the current frame image and the reference voltage of a reference voltage terminal. The pre-storage sub-circuit is also used to pre-store a data voltage of a next frame image during a light emitting phase. Since the pixel circuit drives the light emitting device to emit light by using the data voltage and the reference voltage, the influence of a threshold voltage on display uniformity is reduced and the display uniformity is improved.

In addition, in the related art, since there is a voltage drop of the wire in the actual display, it is possible to result in a change in a gate voltage or a source voltage of the driving transistor, thereby resulting in a difference in the display brightness at a distal end and a proximal end of the DIC (Data Integrated Circuit). However, since the above-described pixel circuit according to embodiments of the present disclosure drives the light emitting device to emit light by using the data voltage and the reference voltage without being affected by the voltage drop of the wire, a difference in brightness resulting from the voltage drop of the wire is reduced.

In some embodiments, as shown in FIG. 1, the pixel circuit may also comprise the light emitting device 150. The light emitting device 150 is electrically connected to the light emitting control sub-circuit 140. For example, an anode terminal of the light emitting device 150 is electrically connected to the light emitting control sub-circuit 140, and a cathode terminal of the light emitting device 150 is electrically connected to the common ground terminal 103. For example, the light emitting device 150 may comprise an OLED (Organic Light Emitting Diode) or the like.

Figure 2:
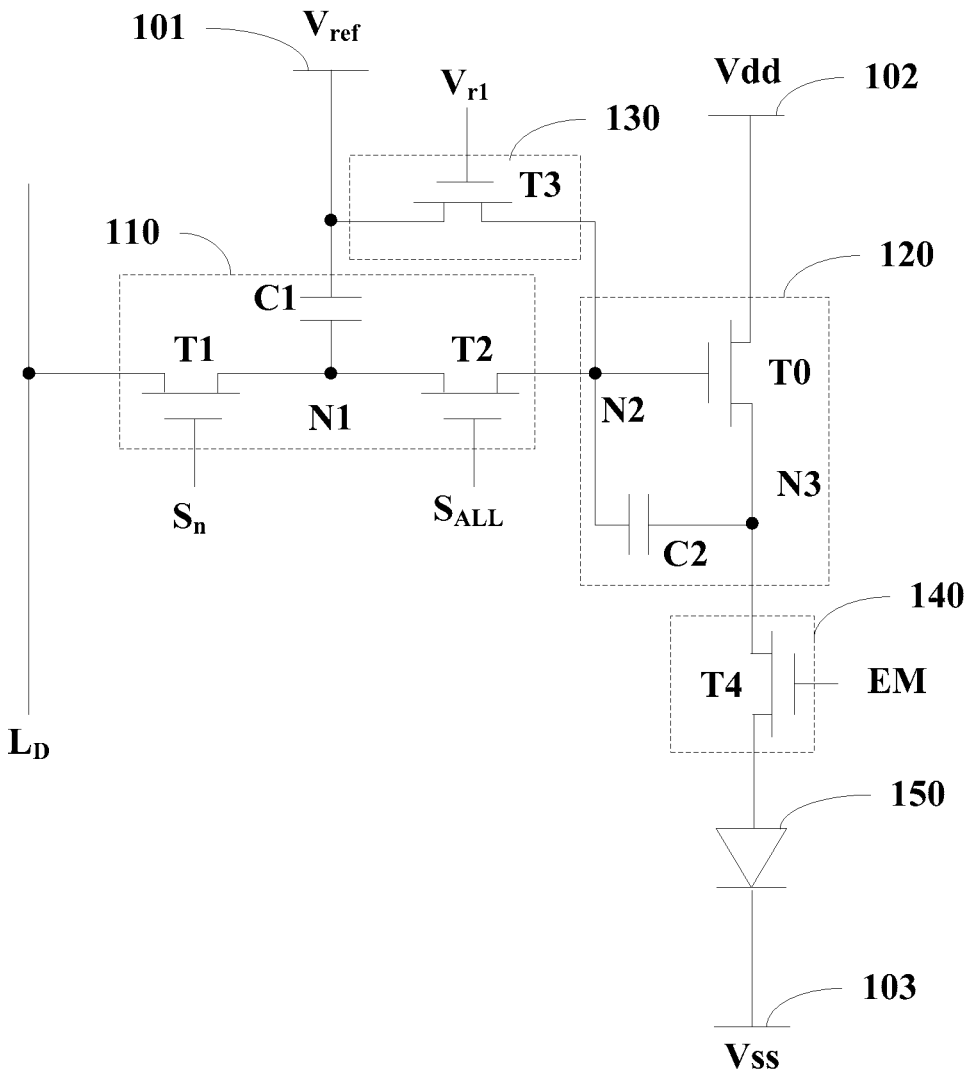
FIG. 2 is a structure diagram showing a pixel circuit according to another embodiment of the present disclosure.

FIG. 2 is a structure diagram showing a pixel circuit according to another embodiment of the present disclosure.

In some embodiments, as shown in FIG. 2, the pre-storage sub-circuit 110 may comprise a first switching transistor T1, a second switching transistor T2, and a first capacitor C1.

A first electrode of the first switching transistor T1 is configured to receive a data voltage (for example, the data voltage of the current frame image or the data voltage of the next frame image) from the data line $L_D$. A second electrode of the first switching transistor T1 is electrically connected to a first node N1. A control terminal (e.g., a gate) of the first switching transistor T1 is configured to receive a strobe signal $S_n$. The first switching transistor T1 is configured to be turned on in response to the strobe signal $S_n$ during the light emitting phase.

For example, as shown in FIG. 2, the first switching transistor T1 may be an NMOS (N-channel Metal Oxide Semiconductor) transistor. The first switching transistor T1 is turned on in a case where a high level signal (which may serve as a strobe signal) is applied, and turned off in a case where a low level signal is applied. Of course, those skilled in the art should understand that the first switching transistor T1 may also be a PMOS (P-channel Metal Oxide Semiconductor) transistor. Therefore, the scope of embodiments of the present disclosure is not only limited thereto.

A first electrode of the second switching transistor T2 is electrically connected to the first node N1. A second electrode of the second switching transistor T2 is electrically connected to a second node N2. A control terminal (e.g., a gate) of the second switching transistor T2 is configured to receive a switching signal $S_{ALL}$. The second switching transistor T2 is configured to be turned on in response to the switching signal during the data providing phase.

For example, as shown in FIG. 2, the second switching transistor T2 may be an NMOS transistor. The second switching transistor T2 is turned on in a case where a high level switching signal is applied, and turned off in a case where a low level switching signal is applied. Of course, those skilled in the art should understand that the second switching transistor T2 may also be a PMOS transistor. Therefore, the scope of embodiments of the present disclosure is not only limited thereto.

An end of the first capacitor C1 is electrically connected to the reference voltage terminal 101. Another end of the first capacitor C1 is electrically connected to the first node N1.

In this embodiment, the pre-storage sub-circuit may provide the data voltage of the current frame image pre-stored at the first node N1 to the driving sub-circuit during the data providing phase, and pre-store the data voltage of the next frame image from the data line $L_D$ at the first node during the light emitting phase, so as to provide the data voltage of the next frame image during a next data providing phase.

In some embodiments, as shown in FIG. 2, the driving sub-circuit 120 may comprise a driving transistor T0 and a second capacitor C2.

A first electrode (e.g., a drain) of the driving transistor T0 is electrically connected to the power supply voltage terminal 102. A second electrode (e.g., a source) of the driving transistor T0 is electrically connected to a third node N3. A control terminal (e.g., a gate) of the driving transistor T0 is electrically connected to the second node N2. For example, the driving transistor may be an NMOS transistor.

An end of the second capacitor C2 is electrically connected to the second node N2. Another end of the second capacitor C2 is electrically connected to the third node N3.

In some embodiments, as shown in FIG. 2, the first reset sub-circuit 130 may comprise a third switching transistor T3. A first electrode of the third switching transistor T3 is electrically connected to the reference voltage terminal 101. A second electrode of the third switching transistor T3 is electrically connected to the second node N2. A control terminal (e.g., a gate) of the third switching transistor T3 is configured to receive a first reset signal $V_{r1}$. The third switching transistor T3 is configured to be turned on in response to the first reset signal $V_{r1}$ during the reset phase.

For example, as shown in FIG. 2, the third switching transistor T3 may be an NMOS transistor. The third switching transistor T3 is turned on in a case where a high level first reset signal is applied, and turned off in a case where a low level first reset signal is applied. Of course, those skilled in the art should understand that the third switching transistor T3 may also be a PMOS transistor. Therefore, the scope of embodiments of the present disclosure is not only limited thereto.

In the first reset sub-circuit of this embodiment, the third switching transistor is turned on during the reset phase, thereby transmitting the reference voltage $V_{ref}$ to the driving sub-circuit 120.

In some embodiments, as shown in FIG. 2, the light emitting control sub-circuit 140 may comprise a fourth switching transistor T4. A first electrode (e.g., a drain) of the fourth switching transistor T4 is electrically connected to the third node N3. A second electrode (e.g., a source) of the fourth switching transistor T4 is electrically connected to an anode terminal of the light emitting device 150. A control terminal (e.g., a gate) of the fourth switching transistor T4 is configured to receive a control signal EM. The fourth switching transistor T4 is configured to be turned on or turned off in response to the control signal EM.

For example, as shown in FIG. 2, the fourth switching transistor T4 may be an NMOS transistor. The fourth switching transistor T4 is turned on in a case where a high level control signal is applied, and turned off in a case where a low level control signal is applied. This may control the driving sub-circuit 120 to couple to or decouple from the light emitting device 150. Of course, those skilled in the art should understand that the fourth switching transistor T4 may also be a PMOS transistor. Therefore, the scope of embodiments of the present disclosure is not only limited thereto.

In the light emitting control sub-circuit of this embodiment, by controlling the fourth switching transistor to be turned on or off, it is possible to control the driving sub-circuit to couple to or decouple from the light emitting device, so that the light emitting device may be controlled to emit light or not.

In embodiments of the present disclosure, the signals EM, $S_{ALL}$, $S_n$ and $V_{r1}$ are pulse signals, respectively. The voltages $V_{ref}$, $V_{dd}$, and $V_{ss}$ are DC (direct current) voltage signals, respectively.

Figure 3:
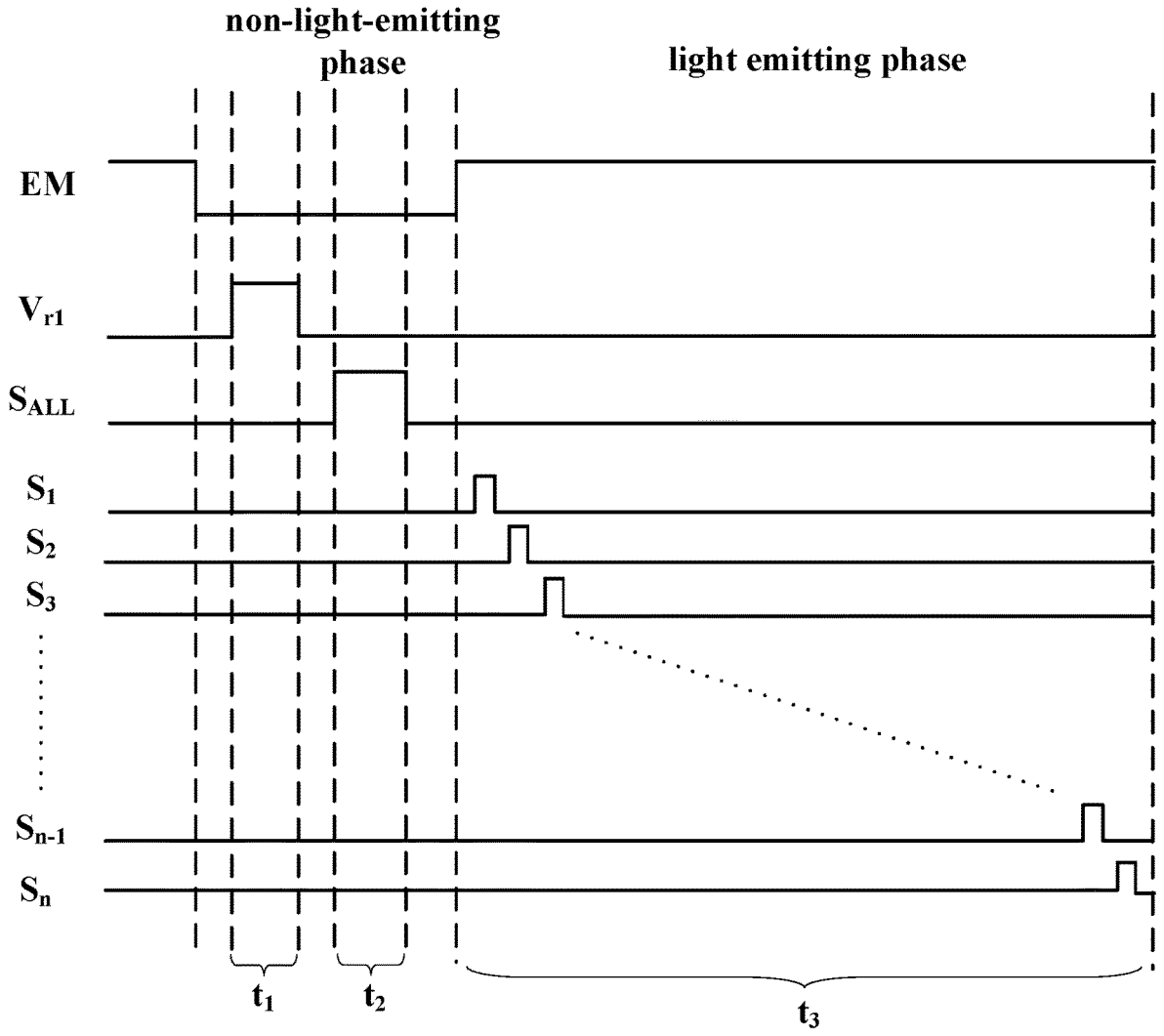
FIG. 3 is a timing diagram showing various signals for a pixel circuit according to an embodiment of the present disclosure.

FIG. 3 is a timing diagram showing various signals for a pixel circuit according to an embodiment of the present disclosure. The operation process of the pixel circuit according to some embodiments of the present disclosure will be described in detail below in conjunction with FIGS. 2 and 3.

In the reset phase $t_1$:

The third switching transistor T3 is turned on, and the first switching transistor T1, the second switching transistor T2, and the fourth switching transistor T4 are all turned off. The potential of the first node N1 is a pre-stored data voltage $V_D$ of a current frame image to be displayed, that is, a data voltage written during the previous time period $t_3$.

Since the driving transistor T0 is an NMOS transistor and a previous frame image is displayed during a previous light emitting stage in a case where the driving transistor operates, the driving transistor T0 operates in a non-cut-off region. The condition that an NMOS transistor satisfies when operating in the non-cut-off region (for example, a saturation region or a linear region) is the gate-source voltage $V_{gs}>V_{th}$ (threshold voltage). After the first reset signal $V_{r1}$ changes from a low level to a high level, the third switching transistor T3 is turned on, so that the potential of the second node N2 is the reference voltage $V_{ref}$. The instantaneous state of the driving transistor T0 is $V_{gs}>V_{th}$, so that there is a current flowing through the third node N3 at this time. Since the potential of the second node N2 is always $V_{ref}$, the second capacitor C2 may be charged, and the potential of the third node N3 is raised. Finally, the charging process reaches a stop state, and the potential of the third node N3 is raised to $V_{ref}-V_{th}$. At this time, the gate-source voltage $V_{gs}$ of the driving transistor T0 is $V_{gs}=V_{th}$. The driving transistor T0 may be considered to be in a turned-off state. At this time, a voltage value stored in the second capacitor C2 is the threshold voltage $V_{th}$ of the driving transistor T0.

During the data providing phase t2 after the reset phase $t_1$:

The switching signal $S_{ALL}$ of the pixel circuit has a high level, and the second switching transistor T2 is turned on, so that the first node N1 and the second node N2 have the same potential. Suppose that the potential of the second node N2 is $V_g$ and the potential of the third node N3 is $V_x$. The voltages on both ends of the first capacitor C1 are $V_{ref}$ and $V_D$ respectively, and the voltage stored in the second capacitor C2 is $V_{th}$. It can be known from charge conservation that $$(V_{ref}-V_D)\cdot C_1+V_{th}\cdot C_2=(V_{ref}-V_x)\left(\frac{1}{C_1}+\frac{1}{C_2}\right)^{-1}, \tag{1}$$

wherein, $C_1$ is a capacitance value of the first capacitor, and $C_2$ is a capacitance value of the second capacitor.

Suppose that the frequency of the switching signal $S_{ALL}$ is f, then the impedance of the first capacitor is $$\frac{1}{C_1 s},$$

and the impedance of the second capacitor is $$\frac{1}{C_2 s},$$

wherein $s=2\pi fj$. Thus, $$\frac{(V_{ref}-V_x)}{\left(\frac{1}{C_1 s}+\frac{1}{C_2 s}\right)}\cdot\frac{1}{C_2 s}=V_g-V_x. \tag{2}$$

Therefore, $$(V_{ref}-V_x)\left(\frac{1}{C_1}+\frac{1}{C_2}\right)^{-1}\cdot\frac{1}{C_2}+V_x=V_g. \tag{3}$$

Based on the formulas (1) and (3), it may be obtained that $$V_g=V_x+[(V_{ref}-V_D)\cdot C_1+V_{th}\cdot C_2]\cdot\frac{1}{C_2}. \tag{4}$$

According to the formula (4), it may be obtained that $$V_g=V_x+(V_{ref}-V_D)\frac{C_1}{C_2}+V_{th}. \tag{5}$$

Since $V_x=V_s$, $V_s$ is a source voltage of the driving transistor, and $V_{gs}=V_g-V_s=V_g-V_x$, then $$V_{gs}-V_{th}=\frac{C_1}{C_2}(V_{ref}-V_D). \tag{6}$$

During the light emitting phase $t_3$ (the phase t3 is also a data writing phase) after the data providing phase $t_2$:

The fourth switching transistor T4 is turned on, and the potential of $V_s$ becomes $V_{oled}+V_{ss}$, wherein $V_{oled}$ is a voltage between the anode terminal and the cathode terminal of the light emitting device 150. However, the difference $V_{gs}-V_{th}$ between the gate-source voltage $V_{gs}$ and the threshold voltage $V_{th}$ of the driving transistor T0 is still $$\frac{C_1}{C_2}(V_{ref}-V_D).$$

Therefore, the driving current $I_{DS}$ output by the driving transistor T0 is $$I_{DS}=\frac{1}{2}\mu C_{OX}\frac{W}{L}(V_{gs}-V_{th})^2=\frac{1}{2}\mu C_{OX}\frac{W}{L}\left(\frac{C_1}{C_2}(V_{ref}-V_D)\right)^2, \tag{7}$$

wherein μ is an effective carrier mobility, $C_{OX}$ is a capacitance of the driving transistor, W/L is an aspect ratio of the driving transistor, and μ, $C_{OX}$ and W/L are all known parameters.

It may be seen from the above-described formula (7) that, the driving current for driving the light emitting device to emit light is related to the reference voltage $V_{ref}$ and the data voltage $V_D$. Thus, the light emitting brightness of the light emitting device is also related to the reference voltage $V_{ref}$ and the data voltage $V_D$. The light emitting brightness of the light emitting device neither is affected by the threshold voltage $V_{th}$, nor is affected by a voltage drop of the power line.

During the light emitting phase $t_3$, a data voltage of a next frame image is written into the first node N1 in each pixel circuit line by line using a timing sequence.

In this embodiment, a data voltage writing process (i.e., a pre-storage process) is set within the light emitting phase, and a threshold voltage compensating process (comprising the reset phase $t_1$ and the data providing phase $t_2$) is set within the non-light-emitting phase. This causes that the threshold voltage compensating process is separated from the data voltage writing process. Moreover, a data voltage writing time may be ignored when it is compared to a light emitting time. This may reduce the problem that the data voltage is written insufficiently, and may improve the response speed of the pixel circuit to some extent.

In the above-described embodiment, the pixel circuit needs to pre-store the data voltage.

In some embodiments, a preset data voltage may be pre-written into the pixel circuit before an actual first frame image is displayed. During a $t_3$ phase of an initial timing cycle, the light emitting control sub-circuit may be turned off by controlling the EM signal, so that the light emitting device does not emit light. That is, it is impossible to display an image according to the preset data voltage, so that the display of a subsequent real image is not affected. Moreover, during the t3 phase of the initial timing cycle, a data voltage required for the actual first frame image is pre-stored to the pre-storage sub-circuit. Then, in a next timing cycle, the actual first frame image may be displayed according to the data voltage of the first frame image. Moreover, in the process of displaying the actual first frame image, a data voltage required for a second frame image is written into the pre-storage sub-circuit. Next, in a process of displaying the second frame image, a data voltage required for a third frame image is written into the pre-storage sub-circuit, and so on.

Figure 4:
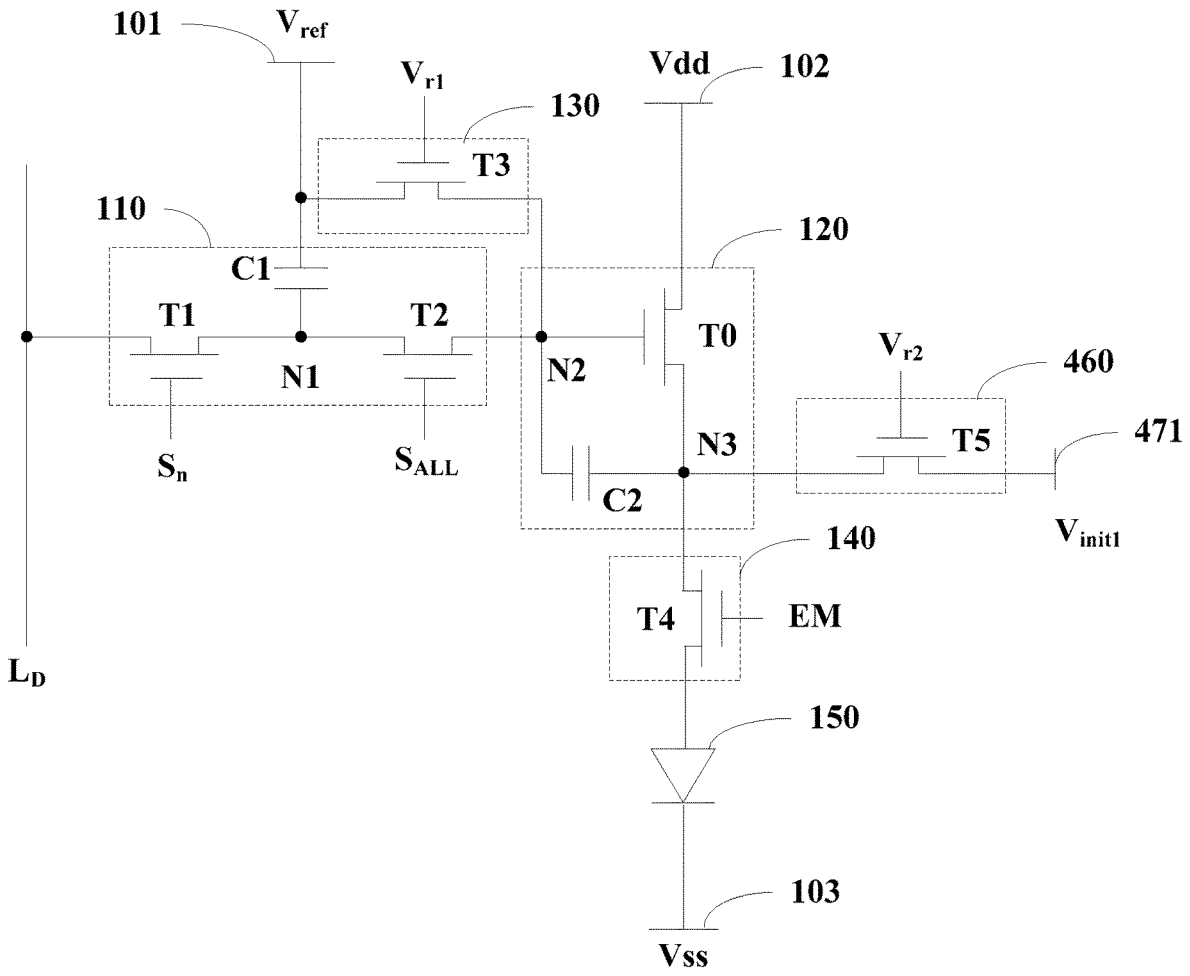
FIG. 4 is a structure diagram showing a pixel circuit according to another embodiment of the present disclosure.

FIG. 4 is a structure diagram showing a pixel circuit according to another embodiment of the present disclosure.

On the basis of the pixel circuit shown in FIG. 2, the pixel circuit shown in FIG. 4 may further comprise a second reset sub-circuit 460. The second reset sub-circuit 460 is configured to reset a potential of the third node N3 in response to a second reset signal $V_{r2}$ during the reset phase. In this embodiment, all third nodes of the pixel circuits for a full screen may be reset to a same voltage, and the potential of the anode terminal of the light emitting device may be lowered, which reduces the light emitting phenomenon of the light emitting device resulting from creepage caused by a parasitic capacitance. Although a brightness of the light emitting phenomenon is small, it may result in that the display contrast is reduced. Therefore, the display contrast may be improved by setting the second reset sub-circuit.

In some embodiments, as shown in FIG. 4, the second reset sub-circuit 460 may comprise a fifth switching transistor T5. A first electrode of the fifth switching transistor T5 is electrically connected to the third node N3. A second electrode of the fifth switching transistor T5 is electrically connected to a first voltage terminal 471. The first voltage terminal 471 is used to provide a first voltage $V_{init1}$ (e.g., −3V). A control terminal (e.g., a gate) of the fifth switching transistor T5 is configured to receive the second reset signal $V_{r2}$. The fifth switching transistor T5 is configured to be turned on in response to the second reset signal $V_{r2}$ during the reset phase. After the fifth switching transistor T5 is turned on, the potential of the third node N3 is reset to the first voltage $V_{init1}$.

For example, as shown in FIG. 4, the fifth switching transistor T5 may be an NMOS transistor. The fifth switching transistor T5 is turned on in a case where a high level second reset signal is applied, and turned off in a case where a low level second reset signal is applied. Of course, those skilled in the art should understand that the fifth switching transistor T5 may also be a PMOS transistor. Therefore, the scope of embodiments of the present disclosure is not only limited thereto.

In some embodiments, in a case where the fifth switching transistor T5 and the third switching transistor T3 are transistors having a same type (for example, both NMOS transistors or both PMOS transistors), the second reset signal may be set to be the same as the first reset signal. In this way, the potentials of two nodes may be reset by using one reset signal, so that it is more convenient to implement.

In other embodiments, in a case where the fifth switching transistor T5 and the third switching transistor T3 are transistors having opposite types (i.e. one transistor is an NMOS transistor, while the other transistor is a PMOS transistor), the second reset signal may be set to be opposite to the first reset signal.

Figure 5:
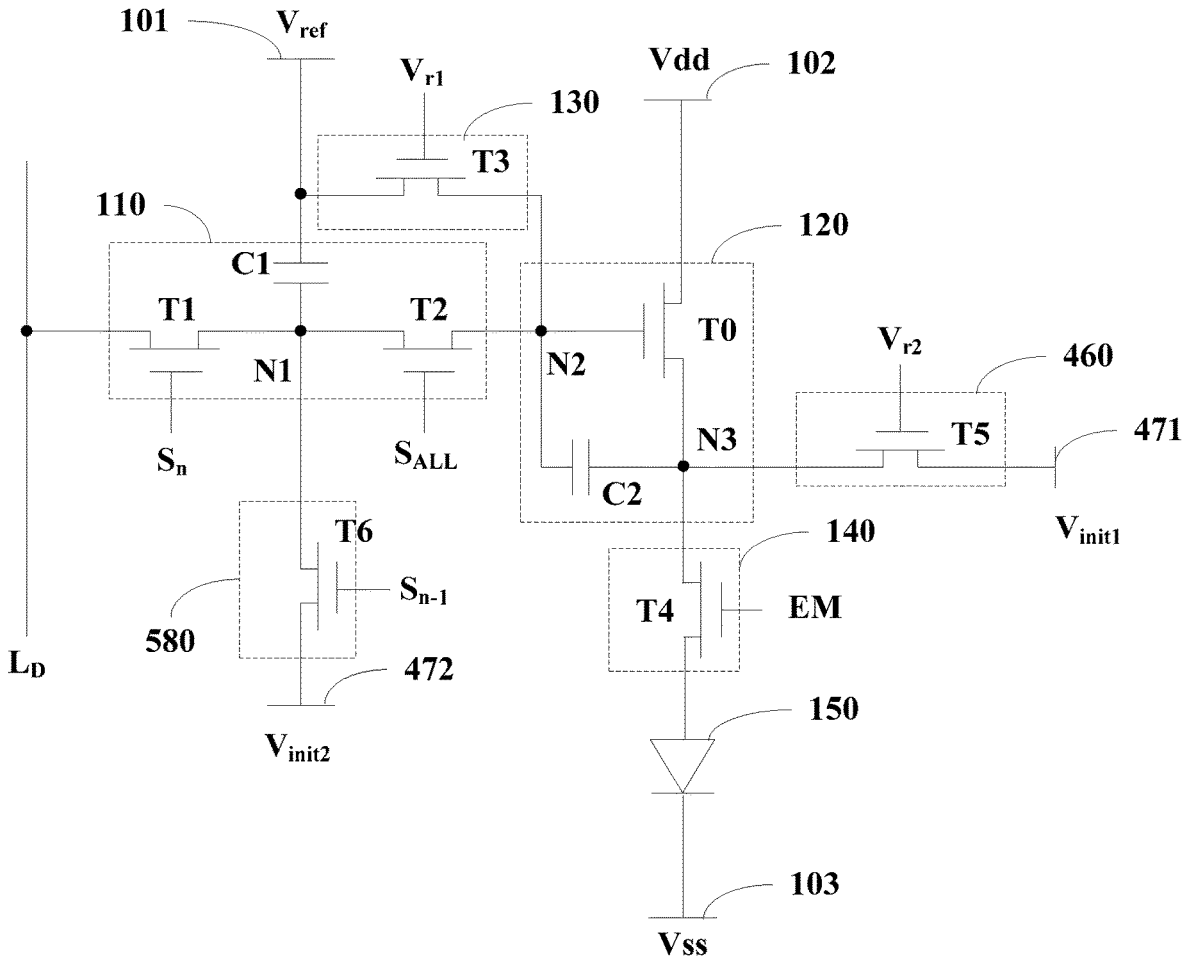
FIG. 5 is a structure diagram showing a pixel circuit according to another embodiment of the present disclosure.

FIG. 5 is a structure diagram showing a pixel circuit according to another embodiment of the present disclosure.

On the basis of the pixel circuit shown in FIG. 4, the pixel circuit shown in FIG. 5 may further comprise a third reset sub-circuit 580. The third reset sub-circuit 580 is configured to reset a potential of the first node N1 before the data voltage of the next frame image is stored at the first node N1. In this embodiment, all first nodes of the pixel circuits for a full screen may be reset to a same voltage, so that it is possible to improve the display uniformity to some extent.

In some embodiments, as shown in FIG. 5, the third reset sub-circuit 580 may comprise a sixth switching transistor T6. A first electrode of the sixth switching transistor T6 is electrically connected to the first node N1. A second electrode of the sixth switching transistor T6 is electrically connected to a second voltage terminal 472. The second voltage terminal 472 is used to provide a second voltage $V_{init2}$ (e.g., −3V). A control terminal (e.g., a gate) of the sixth switching transistor T6 is configured to receive a third reset signal. The sixth switching transistor T6 is configured to be turned on in response to the third reset signal. After the sixth switching transistor T6 is turned on, the potential of the first node N1 is reset to the second voltage Vinit2.

For example, as shown in FIG. 5, the sixth switching transistor T6 may be an NMOS transistor. The sixth switching transistor T6 is turned on in a case where a high level signal (which may serve as the third reset signal) is applied, and turned off in a case where a low level signal is applied. Of course, those skilled in the art should understand that the sixth switching transistor T6 may also be a PMOS transistor. Therefore, the scope of embodiments of the present disclosure is not only limited thereto.

In some embodiments, in a case where a strobe signal received by the first switching transistor T1 is an nth strobe signal $S_n$, the third reset signal is an (n−1)th strobe signal $S_{n-1}$, wherein n is a positive integer no less than 2. This makes it possible to reset the potential of the first node N1 before the data voltage of the next frame image is stored at the first node N1.

In some embodiments, in a case where the strobe signal received by the first switching transistor T1 is the first strobe signal $S_1$ (i.e., the current pixel circuit is a pixel circuit in the first row), an additional GOA (Gate Driver on Array) circuit may be added to provide an 0th strobe signal $S_0$. The strobe signal $S_0$ serves as a third reset signal input to the pixel circuit in the first row, so that the potential of the first node N1 of the pixel circuit in the first row is reset. For example, in a timing sequence, the 0th strobe signal $S_0$ is within a time period of the light emitting phase $t_3$ and before the first strobe signal $S_1$.

It should be noted that the pixel circuit shown in FIG. 5 comprises the second reset sub-circuit and the third reset sub-circuit. However, the scope of embodiments of the present disclosure is not limited thereto. For example, in some embodiments, a pixel circuit on the basis of the pixel circuit shown in FIG. 2 may further comprise the third reset sub-circuit without comprising the second reset sub-circuit.

Figure 6:
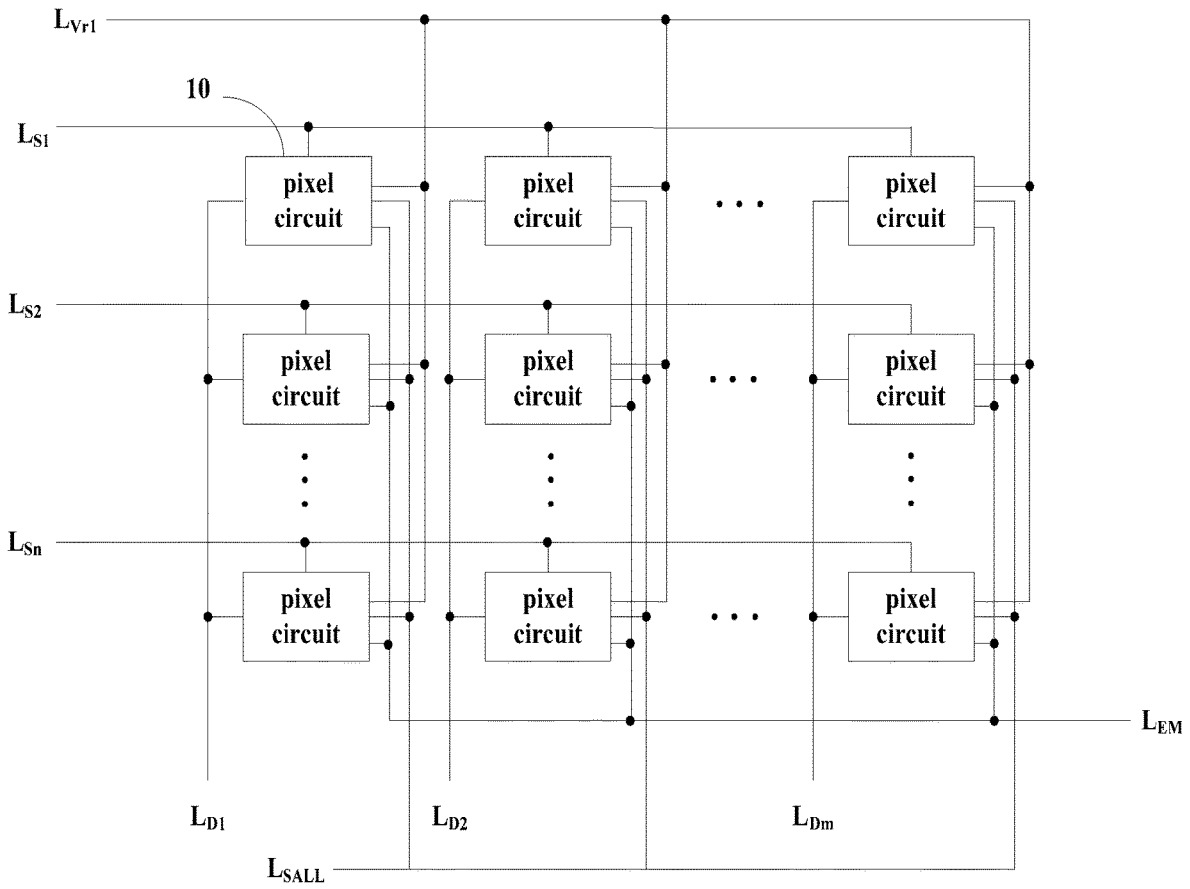
FIG. 6 is a structure diagram showing a pixel array according to an embodiment of the present disclosure.

FIG. 6 is a structure diagram showing a pixel array according to an embodiment of the present disclosure. As shown in FIG. 6, the pixel array comprise a plurality of pixel circuits 10, for example n×m pixel circuits 10 (n and m are positive integers). For example, the pixel circuit 10 may be the pixel circuit as shown in FIG. 1, 2, 4 or 5.

As shown in FIG. 6, the pixel array may further comprise a plurality of data lines $L_{D1}$ to $L_{Dm}$. Each of the data lines is electrically connected to pixel circuits in a same column of the pixel array. For example, the first data line $L_{D1}$ is electrically connected to the pixel circuits in the first column, the mth data line $L_{Dm}$ is electrically connected to the pixel circuits in the mth column, and the like. Each of the data lines is configured to provide a data voltage to a corresponding pixel circuit.

As shown in FIG. 6, the pixel array may further comprise a plurality of strobe signal lines $L_{S1}$ to $L_{Sn}$. Each of the strobe signal lines is electrically connected to pixel circuits in a same row of the pixel array. For example, the first strobe signal line $L_{S1}$ is electrically connected to the pixel circuits in the first row, the nth strobe signal line $L_{Sn}$ is electrically connected to the pixel circuits in the nth row, and the like. Each of the strobe signal lines is configured to provide a strobe signal to a corresponding pixel circuit.

As shown in FIG. 6, the pixel array may further comprise a switching signal line $L_{SALL}$. The switching signal line $L_{SALL}$ is electrically connected to all of the pixel circuits. The switching signal line $L_{SALL}$ is configured to provide the switching signal $S_{ALL}$ to all of the pixel circuits.

In other embodiments, each pixel circuit is connected to one corresponding switching signal line such that a corresponding switching signal may be provided to the each pixel circuit by the one corresponding switching signal line.

As shown in FIG. 6, the pixel array may further comprise a first reset signal line $L_{Vr1}$. The first reset signal line $L_{Vr1}$ is electrically connected to all of the pixel circuits. The first reset signal line $L_{Vr1}$ is configured to provide the first reset signal $V_{r1}$ to all of the pixel circuits.

As shown in FIG. 6, the pixel array may further comprise a control signal line $L_{EM}$. The control signal line $L_{EM}$ is electrically connected to all of the pixel circuits. The control signal line $L_{EM}$ is configured to provide the control signal EM to all of the pixel circuits.

Heretofore, a pixel array according to some embodiments of the present disclosure is provided. The pixel array may reduce the influence of the threshold voltage on display uniformity and improve the display uniformity.

In some embodiments, the pixel array may further comprise a second reset signal line (not shown in the drawings). The second reset signal line is electrically connected to all of the pixel circuits. The second reset signal line is configured to provide the second reset signal to all of the pixel circuits.

In some embodiments, the (n−1)th strobe signal $S_{n-1}$ may be introduced into the pixel circuits in the nth row as the third reset signal applied to the third reset sub-circuits of the pixel circuits in the nth row.

In some embodiments, an additional GOA circuit may be added to provide an 0th strobe signal $S_0$. The strobe signal $S_0$ serves as the third reset signal input to the pixel circuits in the first row, so that the potentials of the first nodes N1 of the pixel circuits in the first row are reset. For example, in a timing sequence, the 0th strobe signal $S_0$ is within a time period of the light emitting phase $t_3$ and before the first strobe signal $S_1$.

According to some embodiments of the present disclosure, a display device is also provided. The display device may comprise the pixel array described previously, for example the pixel array shown in FIG. 6. For example, the display device may be any product or member having a display function, such as a display panel, a mobile phone, a tablet computer, a television, a display, a notebook computer, a digital photo frame, a navigator, and the like.

Figure 7:
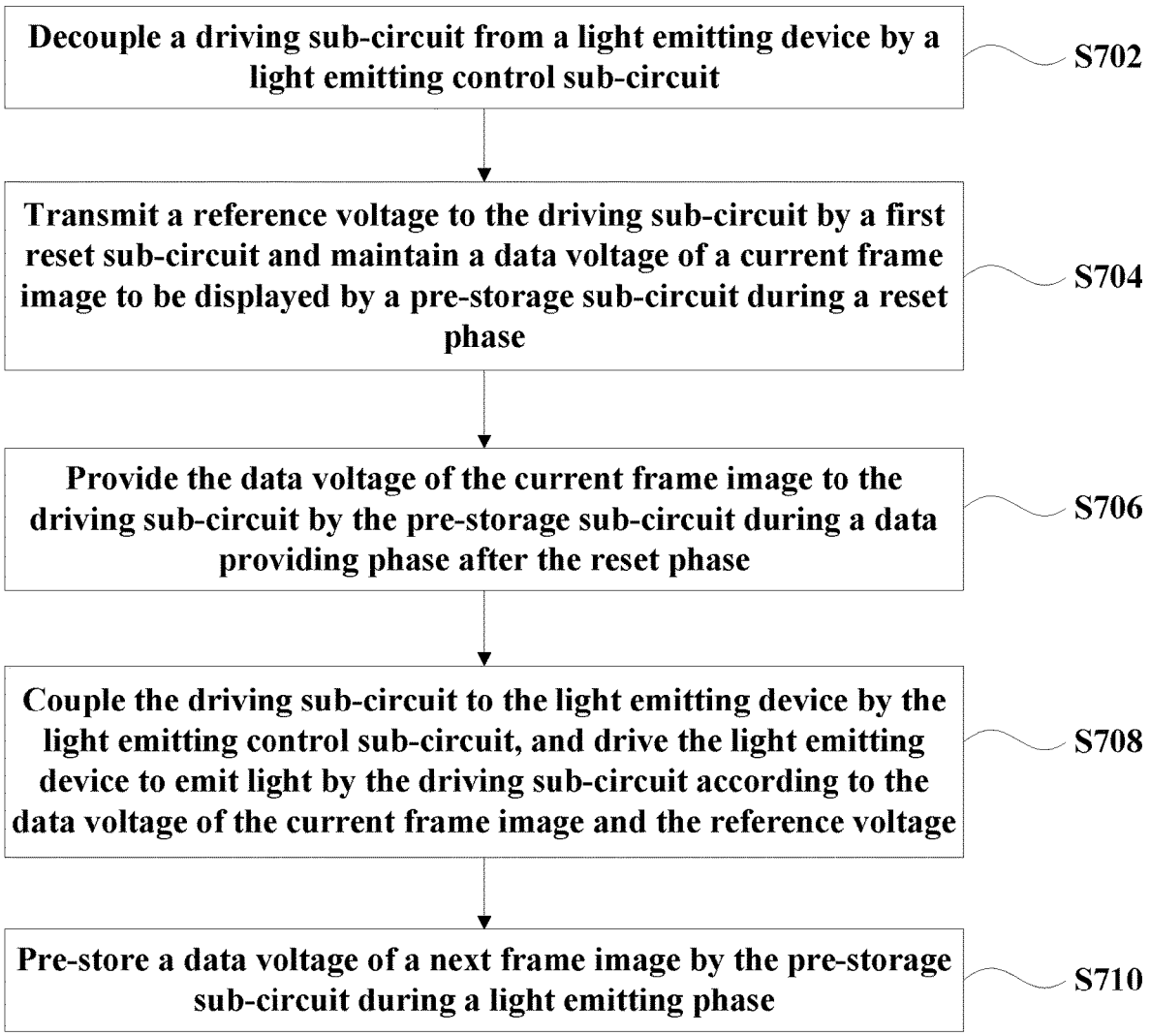
FIG. 7 is a flow chart showing a driving method for a pixel circuit according to an embodiment of the present disclosure.

FIG. 7 is a flow chart showing a driving method for a pixel circuit according to an embodiment of the present disclosure. As shown in FIG. 7, the driving method may comprise steps S702 to S710.

In step S702, a driving sub-circuit is decoupled from a light emitting device by a light emitting control sub-circuit.

In step S704, during a reset phase, a reference voltage is transmitted to the driving sub-circuit by a first reset sub-circuit, and a data voltage of a current frame image to be displayed is maintained by a pre-storage sub-circuit. The reset phase is within a period during which the driving sub-circuit is decoupled from the light emitting device.

In step S706, during a data providing phase after the reset phase, the data voltage of the current frame image to be displayed is provided to the driving sub-circuit by the pre-storage sub-circuit. The data providing phase is within the period during which the driving sub-circuit is decoupled from the light emitting device.

In step S708, the driving sub-circuit is coupled to the light emitting device by the light emitting control sub-circuit, and the light emitting device is driven to emit light by the driving sub-circuit according to the data voltage of the current frame image and the reference voltage.

In step S710, a data voltage of a next frame image is pre-stored by the pre-storage sub-circuit during a light emitting phase.

Heretofore, a driving method for a pixel circuit according to some embodiments of the present disclosure is provided. In this method, since the light emitting device is driven to emit light by using the data voltage and the reference voltage, the influence of the threshold voltage on display uniformity is reduced and the display uniformity is improved.

In some embodiments, the pre-storage sub-circuit may comprise a first switching transistor, a second switching transistor, and a first capacitor. A first electrode of the first switching transistor is configured to receive the data voltage of the current frame image or the data voltage of the next frame image from a data line. A second electrode of the first switching transistor is electrically connected to a first node. A control terminal of the first switching transistor is configured to receive a strobe signal. A first electrode of the second switching transistor is electrically connected to the first node. A second electrode of the second switching transistor is electrically connected to a second node. A control terminal of the second switching transistor is configured to receive a switching signal. An end of the first capacitor is electrically connected to a reference voltage terminal. Another end of the first capacitor is electrically connected to the first node.

In some embodiments, the step S706 may comprise: applying the switching signal to the second switching transistor such that the second switching transistor is turned on to transmit the data voltage of the current frame image to the second node.

In some embodiments, the step S710 may comprise: applying the strobe signal to the first switching transistor during the light emitting phase such that the first switching transistor is turned on to write the data voltage of the next frame image into the first node.

In some embodiments, the driving sub-circuit may comprise a driving transistor and a second capacitor. A first electrode of the driving transistor is electrically connected to a power supply voltage terminal. A second electrode of the driving transistor is electrically connected to a third node. A control terminal of the driving transistor is electrically connected to the second node. An end of the second capacitor is electrically connected to the second node. Another end of the second capacitor is electrically connected to the third node.

In some embodiments, the driving method may further comprise: resetting a potential of the third node by a second reset sub-circuit during the reset phase.

In some embodiments, the driving method may further comprise: resetting a potential of the first node by a third reset sub-circuit before the data voltage of the next frame image is stored at the first node.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features may be made without departing from the scope and spirit of the present disclosure. The scope of the disclosure is defined by the following claims.

What is claimed is:

1. A pixel circuit, comprising:

a pre-storage sub-circuit configured to maintain a data voltage of a current frame image to be displayed during a reset phase, provide the data voltage of the current frame image during a data providing phase, and pre-store a data voltage of a next frame image during a light emitting phase;

a driving sub-circuit configured to drive a light emitting device to emit light according to the data voltage of the current frame image and a reference voltage from a reference voltage terminal;

a first reset sub-circuit electrically connected between the driving sub-circuit and the reference voltage terminal, and configured to be turned on during the reset phase to transmit the reference voltage to the driving sub-circuit and turned off during a time period other than the reset phase; and a light emitting control sub-circuit configured to control the driving sub-circuit to couple to or decouple from the light emitting device, wherein both the data providing phase and the reset phase are within a period during which the driving sub-circuit is decoupled from the light emitting device, wherein the pre-storage sub-circuit comprises:

a first switching transistor, of which a first electrode is configured to receive the data voltage of the current frame image or the data voltage of the next frame image from a data line, a second electrode is electrically connected to a first node, and a control terminal is configured to receive a strobe signal, wherein the first switching transistor is configured to be turned on in response to the strobe signal during the light emitting phase;

a second switching transistor, of which a first electrode is electrically connected to the first node, a second electrode is electrically connected to a second node, and a control terminal is configured to receive a switching signal, wherein the second switching transistor is configured to be turned on in response to the switching signal during the data providing phase; and a first capacitor, of which an end is electrically connected to the reference voltage terminal and another end is electrically connected to the first node; and the pixel circuit comprises:

a third reset sub-circuit configured to reset a potential of the first node before the data voltage of the next frame image is stored at the first node.

2. The pixel circuit according to claim 1, wherein the driving sub-circuit comprises:

a driving transistor, of which a first electrode is electrically connected to a power supply voltage terminal, a second electrode is electrically connected to a third node, and a control terminal is electrically connected to the second node; and a second capacitor, of which an end is electrically connected to the second node and another end is electrically connected to the third node.

3. The pixel circuit according to claim 2, wherein the light emitting control sub-circuit comprises:

a fourth switching transistor, of which a first electrode is electrically connected to the third node, a second electrode is electrically connected to an anode terminal of the light emitting device, and a control terminal is configured to receive a control signal, wherein the fourth switching transistor is configured to be turned on or off in response to the control signal.

4. The pixel circuit according to claim 2, further comprising:

a second reset sub-circuit configured to reset a potential of the third node in response to a second reset signal during the reset phase.

5. The pixel circuit according to claim 4, wherein the second reset sub-circuit comprises:

a fifth switching transistor, of which a first electrode is electrically connected to the third node, a second electrode is electrically connected to a first voltage terminal, and a control terminal is configured to receive the second reset signal, wherein the fifth switching transistor is configured to be turned on in response to the second reset signal during the reset phase.

6. The pixel circuit according to claim 1, wherein the first reset sub-circuit comprises:

a third switching transistor, of which a first electrode is electrically connected to the reference voltage terminal, a second electrode is electrically connected to the second node, and a control terminal is configured to receive a first reset signal, wherein the third switching transistor is configured to be turned on in response to the first reset signal during the reset phase.

7. The pixel circuit according to claim 1, wherein the third reset sub-circuit comprises:

a sixth switching transistor, of which a first electrode is electrically connected to the first node, a second electrode is electrically connected to a second voltage terminal, and a control terminal is configured to receive a third reset signal, wherein the sixth switching transistor is configured to be turned on in response to the third reset signal.

8. The pixel circuit according to claim 7, wherein in a case where the strobe signal received by the first switching transistor is an nth strobe signal, the third reset signal is an (n−1)th strobe signal, wherein n is a positive integer no less than 2.

9. The pixel circuit according to claim 1, wherein the light emitting device is electrically connected to the light emitting control sub-circuit.

10. A pixel array, comprising a plurality of pixel circuits according to claim 1.

11. A display device, comprising the pixel array according to claim 10.

12. A driving method for a pixel circuit, comprising:

decoupling a driving sub-circuit from a light emitting device by a light emitting control sub-circuit;

transmitting a reference voltage to the driving sub-circuit by a first reset sub-circuit and maintaining a data voltage of a current frame image to be displayed by a pre-storage sub-circuit during a reset phase, wherein the reset phase is within a period during which the driving sub-circuit is decoupled from the light emitting device;

providing the data voltage of the current frame image to the driving sub-circuit by the pre-storage sub-circuit during a data providing phase after the reset phase, wherein the data providing phase is within the period during which the driving sub-circuit is decoupled from the light emitting device;

coupling the driving sub-circuit to the light emitting device by the light emitting control sub-circuit, and driving the light emitting device to emit light by the driving sub-circuit according to the data voltage of the current frame image and the reference voltage; and pre-storing a data voltage of a next frame image by the pre-storage sub-circuit during a light emitting phase, wherein the pre-storage sub-circuit comprises a first switching transistor, a second switching transistor and a first capacitor, a first electrode of the first switching transistor configured to receive the data voltage of the current frame image or the data voltage of the next frame image from a data line, a second electrode of the first switching transistor electrically connected to a first node, a control terminal of the first switching transistor configured to receive a strobe signal, a first electrode of the second switching transistor electrically connected to the first node, a second electrode of the second switching transistor electrically connected to a second node, and a control terminal of the second switching transistor configured to receive a switching signal, an end of the first capacitor electrically connected to a reference voltage terminal, and another end of the first capacitor electrically connected to the first node, and wherein the providing the data voltage of the current frame image by the pre-storage sub-circuit comprises: applying the switching signal to the second switching transistor such that the second switching transistor is turned on to transmit the data voltage of the current frame image to the second node;

the pre-storing the data voltage of the next frame image by the pre-storage sub-circuit comprises: applying the strobe signal to the first switching transistor during the light emitting phase such that the first switching transistor is turned on to write the data voltage of the next frame image into the first node; and the driving method, further comprises:

resetting a potential of the first node by a third reset sub-circuit before the data voltage of the next frame image is stored at the first node.

13. The driving method according to claim 12, wherein the driving sub-circuit comprises a driving transistor and a second capacitor, a first electrode of the driving transistor electrically connected to a power supply voltage terminal, a second electrode of the driving transistor electrically connected to a third node, a control terminal of the driving transistor electrically connected to the second node, an end of the second capacitor electrically connected to the second node, and another end of the second capacitor electrically connected to the third node; and the driving method further comprises: resetting a potential of the third node by a second reset sub-circuit during the reset phase.

* * * * *